US007690510B2

(12) United States Patent
Sattel et al.

(10) Patent No.: US 7,690,510 B2
(45) **Date of Patent: *Apr. 6, 2010**

(54) CHILD-PROOF CARTON PACKAGE

(75) Inventors: Oliver Sattel, Geislingen (DE); Meino Adam, Heidenheim (DE); Juergen Dambacher, Eberbach (DE); Dirk Bauernfeind, Wurzach (DE); Peter Fuhrmann, Laupheim (DE); Detlev Gertitschke, Laupheim (DE); Holger Bugar, Schwendi (DE)

(73) Assignees: Carl Edelmann GmbH (DE); Uhlmann Pac-Systeme GmbH & Co. KG (DE)

( * ) Notice: Subject to any disclaimer, the term of this patent is extended or adjusted under 35 U.S.C. 154(b) by 322 days.

This patent is subject to a terminal disclaimer.

(21) Appl. No.: 11/716,292

(22) Filed: Mar. 9, 2007

(65) Prior Publication Data

US 2008/0217204 A1 Sep. 11, 2008

(51) Int. Cl.
*B65D 83/04* (2006.01)

(52) U.S. Cl. ..... 206/528

(58) Field of Classification Search ..... 206/528, 206/531, 532, 534.1, 534.2, 536, 538
See application file for complete search history.

(56) References Cited

U.S. PATENT DOCUMENTS

| | | | | |
|---|---|---|---|---|
| 4,125,190 | A | 11/1978 | Davie, Jr. et al. | |
| 6,047,829 | A | 4/2000 | Johnstone | |
| 6,230,893 | B1 | 5/2001 | Karow | |
| 6,491,211 | B1 | 12/2002 | Evans et al. | |
| 2003/0047482 | A1* | 3/2003 | Jones et al. | 206/534 |
| 2003/0085262 | A1 | 5/2003 | Evans et al. | |
| 2004/0050748 | A1* | 3/2004 | Ehrlund | 206/538 |
| 2004/0232033 | A1 | 11/2004 | Paliotta et al. | |
| 2007/0068843 | A1* | 3/2007 | Hession | 206/538 |
| 2007/0272586 | A1* | 11/2007 | Hession | 206/532 |
| 2008/0217205 | A1* | 9/2008 | Sattel et al. | 206/531 |

FOREIGN PATENT DOCUMENTS

| | | | |
|---|---|---|---|
| EP | 1 002 744 | A1 | 5/2000 |
| EP | 1 057 744 | A1 | 12/2000 |
| EP | 1 270 440 | B1 | 12/2003 |

* cited by examiner

*Primary Examiner*—Jacob K Ackun, Jr.
(74) *Attorney, Agent, or Firm*—Jansson Shupe & Munger Ltd

(57) ABSTRACT

A childproof package consists of a rectangular folding box of cardboard with at least one strip-like blister pack inside, which can be pulled out from one of the short, narrow sides of the folding box. The folding box is designed to be reclosed in such a way as to be childproof again, and the folding box and the blister pack have cooperating means, which are designed so that the blister pack cannot be pulled completely out of the folding box.

13 Claims, 3 Drawing Sheets

CHILD-PROOF CARTON PACKAGE

FIELD OF THE INVENTION

The invention pertains to a package consisting of a rectangular folding box of cardboard with at least one strip-like blister pack inside, which can be pulled out from one of the short, narrow sides of the folding box.

PRIOR ART

Packages of this type are known in general in the form of medication packages. The blister pack (referred to in the following as "the blister") consists of a strip of stiff plastic material, in which deep-drawn cups are formed, which hold the pills, tablets, capsules, suppositories, etc. After the cups have been filled, they are sealed by a cover foil of limited tensile strength, which is bonded to the plastic strip. This cover foil usually consists of metal, especially aluminum. To remove the medication from the cup, the medication is pushed from the rear of the strip against the cover foil, which is thus broken open. It is obvious that the stiffness of the plastic strip material in the area of the cup has been reduced to such an extent, usually by the deep-drawing process itself, that it is possible to deform the cup by manual pressure.

BACKGROUND OF THE INVENTION

Blisters of this type are not so tamper-proof that it would be impossible, during unsupervised play, for small children to gain access to the medication present in the blister. The legislator will prescribe soon that a primary packaging means—in the present case, a blister which can be completely removed from a folding box—must be childproof. Making a blister childproof, however, demands a relatively expensive design. An example of this is described in EP 1 270 440 B1. Additional prior art involving childproof blisters can be found in U.S. Pat. No. 4,125,190 A, EP 1 057 744 A2, EP 1 002 744 A1, and U.S. Pat. No. 6,047,829 A, to name only a few. Most of these previously known blister packages, however, are childproof only up to the time they are first opened. Once the package has been broken open and is lying around without supervision, it can represent a danger to small children.

The invention is based on the task of providing a package of the type indicated above which, after it has been opened the first time, can be reclosed in such a way as to be childproof again in the legal sense.

This task is accomplished for a package of the type indicated above in that the folding box is designed to be reclosable in a childproof sense, and in that the folding box and the blister package have cooperating means which are designed to prevent the blister pack from being removed completely from the folding box.

SUMMARY OF THE INVENTION

Because, according to the present invention, the folding box and the blister are connected inseparably to each other, the folding box belongs to the primary packaging means and can therefore fulfill the childproofing function as prescribed by law, whereas the blister itself can remain unsecured, i.e. un-childproofed.

The invention proceeds from the train of thought that an adult who has opened a package of the inventive type for the first time to remove a tablet will not leave the packaging lying around open, for in this state the package represents clutter and is in general inconvenient to find and use. Instead, the adult will be induced by the type of packaging to push the blister back into the folding box and to close the folding box, as a result of which the childproofing function is reestablished to the extent that this has not already happened by itself simply by the insertion of the blister into the folding box, as will be the case in the preferred embodiment of the invention.

In a preferred embodiment of the invention, a latching projection with a slanted flank is formed on one of the long edges of the blister, and the folding box has a hollow wall on one of its long, narrow sides. This hollow wall forms a chamber in the interior of the folding box, which is separated from the rest of the space inside the folding box in which the blister is held by a cardboard panel, which has a crease line extending longitudinally more-or-less down the middle and which is slightly curved toward the chamber. This cardboard panel has a cut-out in the middle area of the longitudinal dimension of the folding box. The latching projection of the blister engages in this cut-out. By squeezing the folding box, the previously mentioned cardboard panel can be bent into the chamber to such an extent that the latching projection of the blister is released from its engagement in the cut-out and the blister can be pulled to a limited extent out of the folding box.

In one embodiment of the invention, the blister consists of two strips of unequal length, which are connected integrally to each other at two crease lines, which are parallel to each other and a certain distance apart and which are transverse to the longitudinal dimension of the package. The two strips are thus connected by a web, the boundaries of which are formed by the two crease lines. The dimensions of the web are such that it fills up the free cross section of the interior of the folding box. The length of the shorter strip is such that, after the blister has been pulled out of the folding box as far as possible, this strip can be unfolded freely upward. In the state in which the blister is pushed into the folding box, however, the web forms one of the narrow sides of the rectangular package and thus closes off the folding box at one end. So that the shorter strip cannot be pushed farther into the folding box than the longer strip, it is advantageous to form a projection on the longer strip in the area where, in the normal, closed, state of the package, the free end of the shorter strip rests. This projection projects toward the shorter strip, and the free end of the shorter strip makes contact with the projection. The "normal state" referred to here is the state in which the previously mentioned web is perpendicular to the strip and forms the narrow end of the package.

So that the blister can be pulled out of the folding box more easily, it is advantageous in packages of the type just mentioned to provide at least one of the body walls of the folding box with a finger hole, through which the blister can be gripped. This finger hole will be located in the area where the web of the blister forms one of the shorter narrow sides of the package.

SHORT DESCRIPTION OF THE FIGURES

The invention is described in greater detail below with reference to a preferred exemplary embodiment, illustrated in the drawings.

DETAILED EXPLANATION OF A PREFERRED EMBODIMENT OF THE INVENTION

Figure 1:
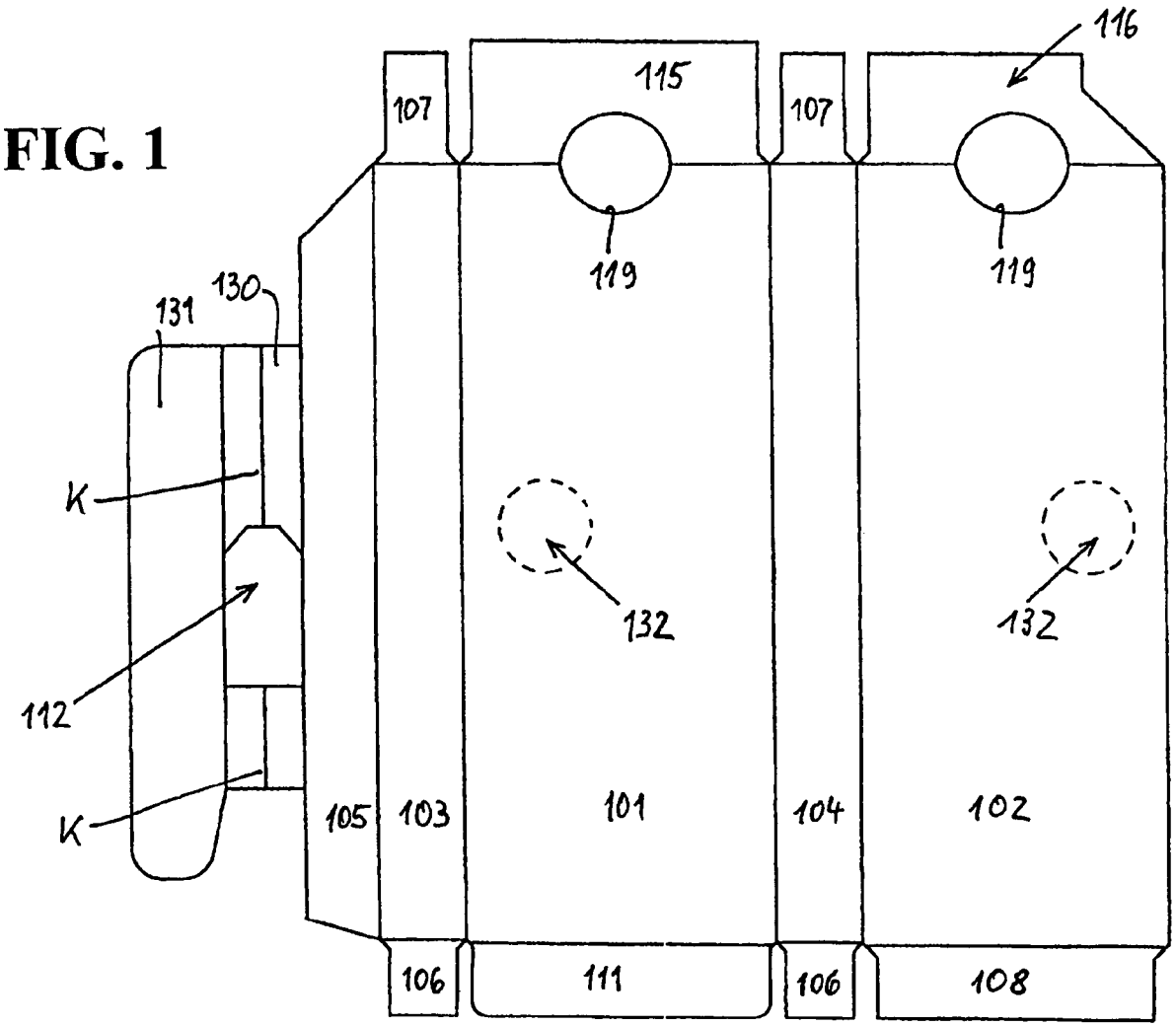
FIG. 1 shows a flat cardboard blank for a package according to a preferred embodiment of the invention.
Figure 2:
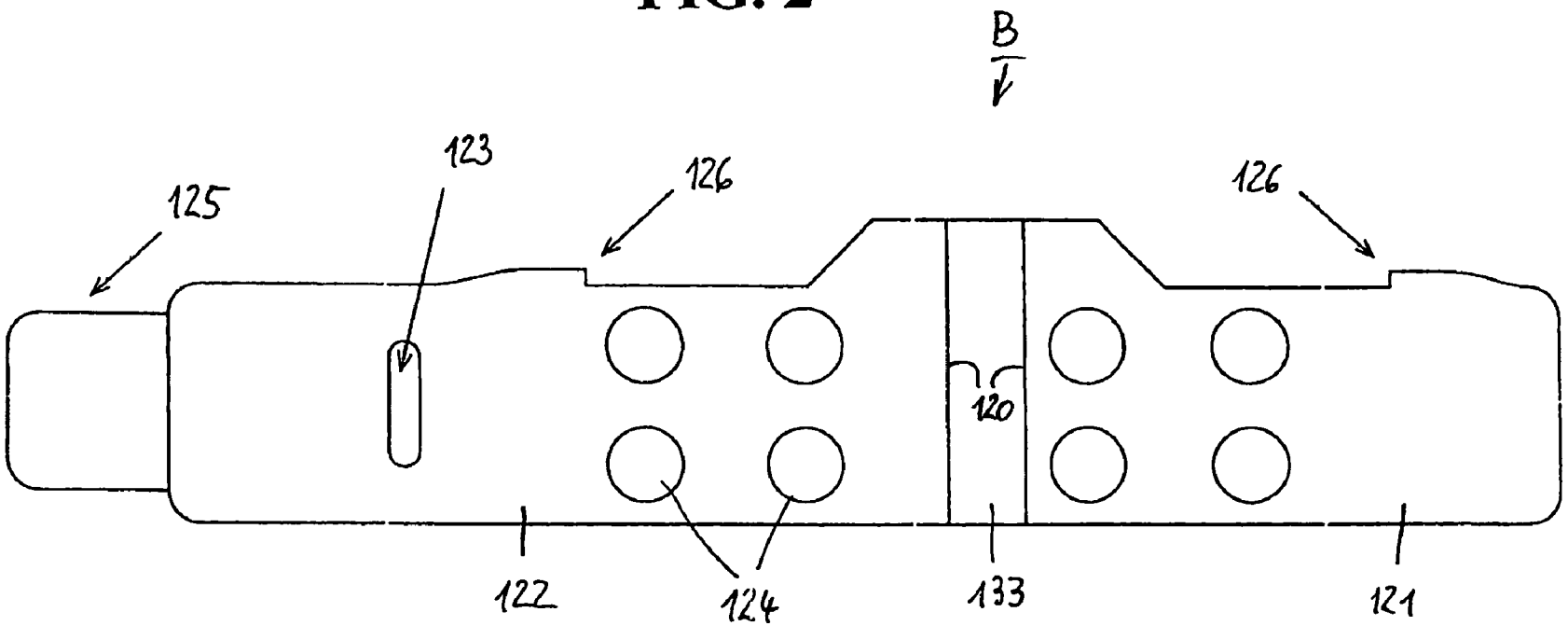
FIG. 2 shows the blister belonging to the embodiment.

FIGS. 1 and 2 show the individual parts of the preferred embodiment of the invention. FIG. 1 shows the flat cardboard blank of a folding box, and FIG. 2 shows the blister B which is intended to be packaged inside the folding box. The blister is shown in the flat, unfolded state.

The folding box consists of two wide body panels 101, 102 and two narrow body panels 103, 104, where a glue tab 105 adjoins the narrow body panel 103. At the end, glue tabs 106 and 107 are attached to the narrow body panels 103, 104. A cover flap 111 is attached to one end of the wide body panel 101, and a glue tab 108 is attached to wide body panel 102 at the same end. At the opposite end, reinforcing flaps 115, 116 are attached. At the fold line which separates the reinforcing tabs 115, 116 from the body panels 101, 102, openings 119 are formed, which create finger holes after the reinforcing flaps 115, 116 have been folded over.

A hollow wall panel 130, which has a cut-out 112, adjoins the glue tab 105, which is itself attached to the narrow body panel 103. Inside the hollow wall panel 130, a crease line K extends down the center. A glue tab 131 adjoins the hollow wall panel 130.

This folding box blank is processed as follows:

The glue tabs 107 and the reinforcing tabs 115, 116 are folded over toward the inside onto the body panels to which they are attached and are glued to them. The narrow body panel 103 is folded up by 90°, the glue tab 105 by an additional 90°, and the hollow wall panel 130 by 90°, so that it is now parallel to the body panel 103. The glue tab 131 is folded in the opposite direction and glued to the inside surface of the wide body panel 101. Then the other body panels 104 and 102 are folded over, and the inside surface of the body panel 102 is glued to the glue tab 105. The folding box is closed by folding in the glue tabs 106 and 108 and gluing them to each other and then by folding over and gluing the cover flap 111 to the glue tab 108.

The folding box which has been closed in this way is accessible at the narrow end where the finger holes 119 are located. At this end, the blister B is now inserted.

According to FIG. 2, the blister B consists of a strip of plastic material, which is divided into two sections 121 and 121 of unequal length, in which wells 124 are formed. The two sections 121 and 122 are separated from each other by two crease lines 120, which are a certain distance apart and extend transversely to the longitudinal dimension of the blister B. In the longer section 122 there is a projection 123. The distance from the projection 123 to the closer of the two crease lines 120 is equal to the distance between the free. narrow edge of the shorter section 121 of the blister B and the crease line 120 closer to it. When the blister B is folded at the crease lines 120, the free edge of the shorter section 121 of the blister rests on the projection 123, which extends inward, i.e., in the same direction as the wells 124. Adjoining the end of the longer section 122 opposite the crease line 120 is a retaining tab 125, which is to be folded over in the direction opposite the folding of the blister, that is, onto the outside surface of the blister B, after it has been folded into the shape of a "U".

Over most of their length, the sections 121 and 122 have a width which is the same as the free residual space inside the folding box between the hollow wall 130 forming the chamber and the opposite narrow body panel 104. In the area next to those sections, adjacent to the two crease lines, the blister B expands to a width which is equal to the free distance between the two narrow body panels 103, 104 of the folding box. In the narrower sections, the sections 121 and 122 have projecting shoulders 126, which merge gently on one side into the narrower dimension of the blister B.

Before the blister B is pushed into the folding box, it is folded at the two crease lines 120 to form a "U"; the retaining tab 125 is then folded over onto the opposite side. The end of the blister to which the retaining tab 125 is attached is now pushed into the folding box until the edges where the projecting shoulders 126 are formed rest next to the hollow wall 130. The projecting shoulders 126 then slide along the hollow wall 130 and engage in the cut-out 112.

"Press Here" marks 132 are applied to the two wide body panels 101, 102 in the area where the shoulders 126 are engaged in the cut-out 112. To open the folding box, the box must be squeezed at the "Press Here" marks 132. As a result, the wall 130, which is curved slightly toward the narrow chamber which it delimits, arches at the crease line K into the previously mentioned chamber toward the adjacent narrow body wall 103, as a result of which the shoulders 126 are released from the cut-out 112. The blister B can now be pulled out of the folding box.

Figure 3:
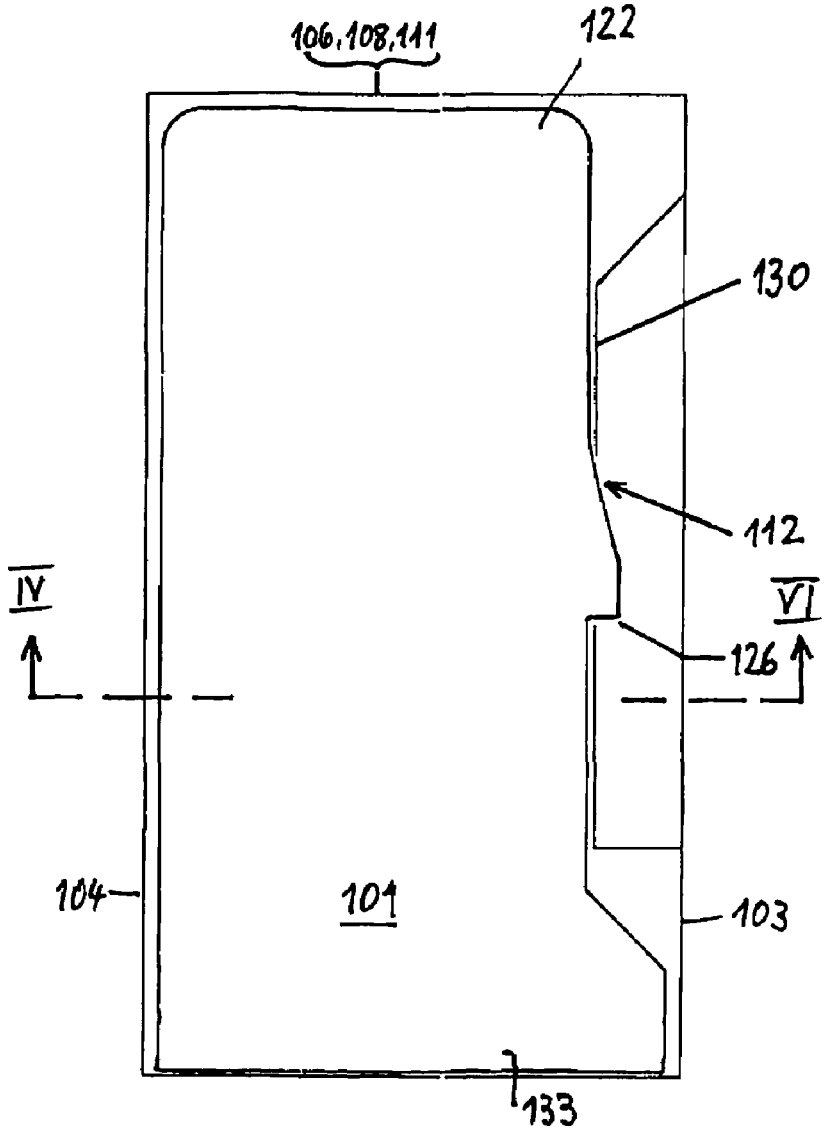
FIG. 3 shows a longitudinal cross section through the package formed by the cardboard blank of FIG. 1 and the blister of FIG. 2 along line III-III of FIG. 4.
Figure 4:
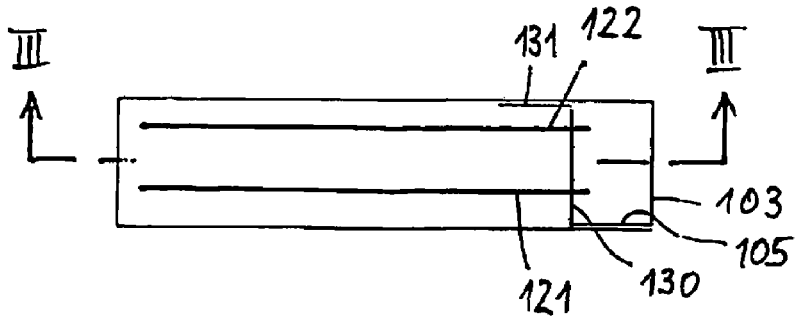
FIG. 4 shows a cross section through the package of FIG. 3 along line IV-IV of FIG. 3.

FIG. 3 shows a longitudinal cross section through the folding box along line III-III of FIG. 4. The outline of the folding box consisting of its body panels 101, 103, and 104 and the glue tabs 106, 108 and the cover flap 111 can be seen. In addition, the cardboard panel 130, which forms the boundary of the chamber, and its cut-out 112 can also be seen. The blister B has been inserted into the folding box. Its longer section 122 and the projecting shoulder 126 can be seen, the shoulder being engaged in the cutout 112 of the cardboard panel 130. The web 133, which closes off the folding box at one narrow side, is also visible. The gap between the web 133 and the walls of the folding box are exaggerated in the drawing for the sake of clarity.

The cross section in FIG. 4, from which the blister wells have been omitted, shows the blister B, consisting of the two sections 121 and 122 and the web 133. The blister has been inserted into the folding box, and the projecting shoulders 126 formed on the sections 121 and 122 are engaged in the cut-out 112 of the cardboard panel 130, which forms one of the boundaries of the chamber. The figure also shows that the previously mentioned cardboard panel 130 has a certain curvature extending toward the chamber delimited by said cardboard panel. This curvature, which is caused by the crease line K, ensures that, when pressure is exerted from the outside on the marks 132 on the folding box, the cardboard panel 130 will bend in a defined direction, namely, away from the projecting shoulders 126, and those shoulders will therefore be released from the cut-out 112.

A small child is not able to perform the combination of movements which are necessary to open the folding box, because the necessary movements proceed in different directions. The folding box is therefore childproof.

It is not possible to pull the blister completely out of the folding box, because the free edge of the folded-over retaining tab 125 runs up against the cardboard edge of the retaining tab 116. In this position, the free edge of the shorter section 121 of the blister B is located in the area of the end of the folding box, so that the blister can be unfolded and a medication can be removed from one of its wells.

The reinforcing tab 116 does not necessarily have to be glued to its adjacent body panel 102. The retaining tab 125 on the blister B would then be extended to an appropriate extent, and when the blister is pulled out of the folding box, the retaining tab 125 will slide behind the reinforcing tab 116, which is returning elastically to its original position, and again hold the blister reliably in the folding box.

By pushing the blister B into the folding box, the medications remaining in the blister can be stored in the folding box in a manner which is again childproof. Because the blister cannot be separated from the folding box, the package overall represents a primary package and fulfills the laws concerning child safety, without the need for the blister B itself to be childproof.

The invention claimed is:

1. A childproof resealable package comprising:

a parallelepiped block-shaped folding box made of cardboard having (a) first and second narrow longitudinal walls, (b) first and second wide longitudinal walls, (c) first and second ends which with the walls define an interior, the first end being a withdrawal end and the second end being a closed end, and (d) a retention member along the first narrow longitudinal wall, the retention member defining a hollow space therealong and adjacent to the first narrow longitudinal wall and having a cardboard panel with a central bending line which bulges toward the hollow space and defines a cut-out opening; and at least one strip-form blister pack within the interior which is withdrawable therefrom and has a locking projection extending from a longitudinal edge thereof into the cut-out opening, the cut-out opening and locking projection being configured and arranged such that the locking projection engages an edge of the cut-out opening to prevent withdrawal of the blister pack from the interior.

2. The package according to claim 1 wherein pinching toward one another of the first and second wide longitudinal walls at positions substantially overlying the bulging cardboard panel temporarily increases the bulging of the cardboard panel toward the hollow space thereby to disengage the projection from the edge of the cut-out opening and freeing the blister pack for partial withdrawal from the box.

3. The package according to claim 2 wherein:

the withdrawal end includes a reinforcing flap folded into the interior; and a bent-over retaining tab extends from the blister pack and is configured and arranged such that upon withdrawal of the blister pack from the box such retaining tab engages the reinforcing flap;

whereby complete withdrawal of the blister pack from the box is restricted.

4. The package according to claim 1 wherein:

the blister pack includes first and second sections of different lengths that are integrally connected by a web along two fold lines, the web being sized such that it substantially fills the cross-section of the box interior;

the first and second sections are spaced apart and run substantially parallel to one another away from the web, the second section extending to a distal free edge; and the second section is of a length such that, upon partial withdrawal of the blister pack from the box, the second section and its distal free edge exit the box thereby allowing unfolding of the blister pack.

5. The package according to claim 4 wherein the first section of the blister pack includes a projection extending toward the second section when the blister pack is in its folded configuration, such projection being positioned such that the distal free edge of the second section rests thereon.

6. The package according to claim 4 wherein the first and second wide longitudinal walls each include a finger aperture for gripping the blister pack, the finger apertures being substantially aligned.

7. The package according to claim 4 wherein the first and second wide longitudinal walls each include a press mark, the press marks being substantially aligned and positioned such that pinching of such marks temporarily increases the bulging of the cardboard panel toward the hollow space thereby to disengaging the projection from the edge of the cut-out opening and freeing the blister pack for partial withdrawal from the box.

8. The package according to claim 1 wherein the first and second wide longitudinal walls each include a finger aperture for gripping the blister pack, the finger apertures being substantially aligned.

9. The package according to claim 1 wherein the first and second wide longitudinal walls each include a press mark, the press marks being substantially aligned and positioned such that pinching of such marks temporarily increases the bulging of the cardboard panel toward the hollow space thereby to disengaging the projection from the edge of the cut-out opening and freeing the blister pack for partial withdrawal from the box.

10. The package according to claim 1 wherein:

the blister pack includes first and second sections of different lengths that are integrally connected with one another at a folding end and run substantially parallel to one another;

the second section extends to a distal free edge; and the second section is of a length such that, upon partial withdrawal of the blister pack from the box, the second section and its distal free edge exit the box thereby allowing unfolding of the blister pack.

11. The package according to claim 10 wherein the first section of the blister pack includes a projection extending toward the second section when the blister pack is in its folded configuration, such projection being positioned such that the distal free edge of the second section rests thereon.

12. The package according to claim 1 wherein:

the blister pack includes first and second sections of different lengths that are integrally connected by a web along two fold lines;

the first and second sections are spaced apart and run substantially parallel to one another away from the web, the second section extending to a distal free edge; and the second section is of a length such that, upon partial withdrawal of the blister pack from the box, the second section and its distal free edge exit the box thereby allowing unfolding of the blister pack.

13. The package according to claim 12 wherein the first section of the blister pack includes a projection extending toward the second section when the blister pack is in its folded configuration, such projection being positioned such that the distal free edge of the second section rests thereon.

* * * * *